US010818487B2

(12) United States Patent
O'Banion et al.

(10) Patent No.: US 10,818,487 B2
(45) Date of Patent: Oct. 27, 2020

(54) LIGHT BULB CHANGING DEVICE

(71) Applicants: Michael Lester O'Banion, Westminster, MD (US); Lowell Dean Leuking, Lake Wylie, SC (US); Todd James Huston, Leesburg, VA (US); Hugh Miskel, Marietta, GA (US); Yandong Shen, Guangzhou (CN)

(72) Inventors: Michael Lester O'Banion, Westminster, MD (US); Lowell Dean Leuking, Lake Wylie, SC (US); Todd James Huston, Leesburg, VA (US); Hugh Miskel, Marietta, GA (US); Yandong Shen, Guangzhou (CN)

(73) Assignee: The Holms Group, Lake Wylie, SC (US)

( * ) Notice: Subject to any disclaimer, the term of this patent is extended or adjusted under 35 U.S.C. 154(b) by 0 days.

(21) Appl. No.: 16/052,869

(22) Filed: Aug. 2, 2018

(65) Prior Publication Data

US 2020/0227248 A1 Jul. 16, 2020

(51) Int. Cl.
*H01K 3/32* (2006.01)
*B25B 9/00* (2006.01)

(52) U.S. Cl.
CPC *H01K 3/32* (2013.01); *B25B 9/00* (2013.01)

(58) Field of Classification Search
CPC .. H01K 3/32; H01J 9/003; H01J 9/006; B25B 9/00
See application file for complete search history.

(56) References Cited

U.S. PATENT DOCUMENTS 1,121,759 A * 12/1914 Printiss ..... H01K 3/32 81/53.11
1,201,506 A * 10/1916 Rozelle et al. ..... H01K 3/32 81/53.12
1,202,432 A * 10/1916 Rozelle et al. ..... H01K 3/32 81/53.12
1,514,814 A * 11/1924 Allen ..... H01K 3/32 81/53.11
1,926,948 A * 9/1933 Iffland ..... H01K 3/32 81/53.12
2,357,104 A * 8/1944 Grinnell ..... H01K 3/32 81/53.11
2,357,105 A * 8/1944 Grinnell ..... H01K 3/32 81/53.11
2,594,908 A * 4/1952 Gaulke ..... E21B 11/005 294/86.14
2,616,743 A * 11/1952 Negley ..... H01K 3/32 81/53.12
2,983,541 A * 5/1961 Maki ..... H01K 3/32 81/53.11

(Continued)

*Primary Examiner* — David B. Thomas
(74) *Attorney, Agent, or Firm* — Bechen PLLC

(57) ABSTRACT

A light bulb changing device with expandable fingers is extendable to allow a person to install and remove light bulbs from an elevated ceiling without need for climbing a ladder. The device includes a tube, with the fingers attached thereto. A horn is slidably disposed on the top, movement of the horn adjusts the movement of the fingers. A compression spring and pulley housing with pulleys therein actuate movement of a tension member allowing for opening of the fingers and closing the fingers around a light bulb with limited torque to avoid breaking the light bulb.

20 Claims, 9 Drawing Sheets

(56) References Cited

U.S. PATENT DOCUMENTS

| | | | | | |
|---|---|---|---|---|---|
| 4,663,996 | A * | 5/1987 | Grudgfield | H01K 3/32 | 294/99.1 |
| 4,719,826 | A * | 1/1988 | DuBois | B25B 9/00 | 294/211 |
| 5,317,939 | A * | 6/1994 | Marinescu | H01K 3/32 | 294/100 |
| 6,739,220 | B1 * | 5/2004 | Johnson | B25B 9/00 | 81/53.1 |
| 6,883,400 | B2 * | 4/2005 | Sugano | H01K 3/32 | 294/184 |
| 6,941,841 | B2 * | 9/2005 | Johnson | B25B 9/00 | 81/53.1 |
| 7,143,668 | B2 * | 12/2006 | Johnson | B25B 9/00 | 81/53.1 |
| 7,255,024 | B2 * | 8/2007 | Johnson | H01J 9/003 | 81/53.1 |
| 7,631,579 | B2 * | 12/2009 | Johnson | H01J 9/003 | 81/53.12 |
| 7,665,782 | B2 * | 2/2010 | Buzby | E01H 1/1206 | 294/109 |
| 7,856,907 | B2 * | 12/2010 | Johnson | H01J 9/003 | 81/53.12 |
| 8,104,380 | B2 * | 1/2012 | Johnson | H01K 3/32 | 81/57.12 |
| 8,256,329 | B2 * | 9/2012 | Ota | H01K 3/32 | 81/53.11 |
| 8,448,546 | B2 * | 5/2013 | Johnson | F21V 21/36 | 81/53.12 |
| 8,869,655 | B2 * | 10/2014 | Johnson | F21V 21/36 | 81/57.12 |
| 9,679,760 | B2 * | 6/2017 | Johnson | H01K 3/32 | |
| 2017/0239789 | A1 * | 8/2017 | Sian | B25G 1/04 | |

* cited by examiner

ALFA
15°
FA
Rb
FB
100
110b
110
lb-c
la-c
100a
110a
C
SPRING
FORCE F1
126
125

Rb
$F_A$
ALFA
100
$l_{a-c}$
110b
$F_B$
$l_{B-c}$
C
SPRING
FORCE
$F_4$

LIGHT BULB CHANGING DEVICE

FIELD OF THE INVENTION

The present invention relates to a device which may be used to change a light bulb which is beyond the reach of a person. More specifically, the present invention relates to a mechanical device designed to remove and replace a full range of light bulb sizes having a typical Edison screw base.

BACKGROUND OF THE INVENTION

Numerous light bulb removal tools have been disclosed, manufactured and sold which alleviate the problems associated with replacing light bulbs from remote locations. One such problem is accessibility. Overhead lights are typically positioned on or in a ceiling of a room. Another problem is the adjustability of the handle to reach light bulbs at varying distances. Additionally, light bulbs of vastly different sizes and shapes are available. Another problem Is light bulbs are subject to separation from their metal base if the user applies too much torque while installing. A typical light bulb is tightened to a torque of approximately between 10 and 20-inch pounds regardless of the size of the bulb. Another problem is not providing adequate assurance that the device will hold the bulb without the chance of dropping the bulb and breaking it. Another problem is that many light bulb changing devices do not provide the ability for the user to actuate the mechanism from both the proximal (bottom handle) or distal (upper gripping end) ends. This is necessary to permit a user to install and remove a bulb at a workable height and yet be able to grip and release the bulb at an elevated, not human reachable, height.

U.S. Pat. Nos. 1,202,432 and 1,201,506 to Rozelle et al., both disclose an adjustable device for placing and removing electric light bulbs. The patent teaches that the rods are adjustable to reach light bulbs at different heights, but the mechanism to lock the rods at a desired height is cumbersome. The mechanism to prevent the sliding of the rods consists of pins positioned along the rod which are configured to slide into a bayonet slot cut into the outer surface of the rod. Therefore, the user can only adjust the rod at certain heights, which is burdensome if the light bulb is at a height that does not correspond to any of the positions available on the rod. Further, this patent discloses spring fingers that are actuated by an adjusting spider. Said fingers are limited in adjustment range to a single size bulb. Further, the mechanism to actuate the gripping fingers is only actuatable by the user from the proximal end opposite the fingers, which creates difficulty inserting a replacement bulb into the fingers, due to the necessity of opening and closing the fingers from the proximal end. This invention also does not control the amount of torque which can be applied to a light bulb regardless of the size of the bulb.

U.S. Pat. No. 1,121,759 to Printiss discloses a manually operable device for quickly and safely replacing lamp sockets and bulbs placed beyond the reach of the operator's arm. This patent teaches the use of a compression spring to impart a force on the plurality of clamps and a cord and pulley to guide the cord to a proximal end of the number of jointed sections of handle. This patent also teaches use of a lever and pivot for mechanical advantage reducing the force the operator would need to pull the cord against the force of the compression spring. This invention also does not control the amount of torque which can be applied to a light bulb regardless of the size of the bulb.

U.S. Pat. No. 1,514,814 to Allen, discloses an electric bulb holder which has bulb gripping arms that are pivotally connected to a slidable member which causes the bulb gripping arms to spread around the light bulb and then collapse to grip the light bulb. Once the user has a grip of the light bulb, he must rotate the whole bulb holder to screw or unscrew the light bulb. The means for closing and opening the fingers is by use of a thumb nut and feed screw only actuatable at the distal, or finger end of the device thereby rendering actuation of the fingers at an elevated location difficult or impossible. This invention also does not control the amount of torque which can be applied to a light bulb regardless of the size of the bulb.

U.S. Pat. No. 1,926,948 to Iffland discloses a light bulb changer that has spring fingers that can be regulated to cooperate with different sized bulbs. The spring fingers change their normal shape by manual adjustment of the collar at the distal, finger end of the device. The fingers are only actuatable at the distal, or finger end of the device, thereby rendering actuation of the fingers at an elevated location difficult or impossible. Further, the geometry of the fingers and collar do not provide a large range of adjustment. This invention also does not control the amount of torque which can be applied to a light bulb regardless of the size of the bulb. This invention does not provide the ability to adjust the fingers from both the proximal and distal ends.

U.S. Pat. Nos. 2,357,104 and 2,357,105 to Grinnell, discloses a light bulb changer with pivotable jaws with gripping pads. Said jaws are openable and closable to grip bulbs of widely differing sizes. The patent teaches that the jaws are closable with a compression spring pushing on a wedge cone to close the jaws. Additional extension springs, 20, are employed to open the jaws and a cord is used to actuate the jaws from a proximal end. This invention also does not control the amount of torque which can be applied to a light bulb regardless of the size of the bulb. This invention does not provide the ability to adjust the fingers from both the proximal and distal ends.

U.S. Pat. No. 2,594,908, Gaulke, teaches of a grappling device with resilient grappling means which may be manipulated from the handle portion of the tube. The problem which this invention does not solve is that the grappling means or gripping fingers, when in the most extended position, have very low gripping force due to the very small amount of leverage applied to the fingers. This invention also does not control the amount of torque which can be applied to a light bulb regardless of the size of the bulb. This invention does not provide the ability to adjust the fingers from both the proximal and distal ends.

U.S. Pat. No. 2,616,743 to Negley discloses a light bulb changer having a rigid handle and a bendable arm attached to the handle. Although this light bulb changer allows the user to bend the arm to engage light bulbs at different angles, the light bulb changer does not allow the user to adjust the handle to different heights. Further, the light bulb changer taught by Negley does not allow the user to adjust the mechanism to fit differently sized light bulbs. This invention also does not control the amount of torque which can be applied to a light bulb regardless of the size of the bulb. This invention does not provide the ability to adjust the fingers from both the proximal and distal ends.

U.S. Pat. No. 2,983,541 to Maki discloses a device for removing or placing light bulbs in sockets. Specifically, the device taught by Maki consists of a fixed rod with a bendable arm for reaching light bulbs at different angles. The patent discloses using a helicoidal operating member inside the bendable arm which is bendable and rotatable.

However, the device taught by Maki, by having a fixed rod, does not allow the user to adjust the rod to different heights. Also, the user must use an air bulb to create suction in an engaging cup to engage the light bulb. This is disadvantageous to the user, because the cup is not adjustable to engage different sized light bulbs. This invention also does not control the amount of torque which can be applied to a light bulb regardless of the size of the bulb. This invention does not provide the ability to adjust the fingers from both the proximal and distal ends.

U.S. Pat. No. 4,663,996 to Grudgefield, identifies that incandescent light bulbs are well known and have a metallic base and a glass envelope with a substantially hemispherical end or tip. Irrespective of whether the base is an Edision-Swan screw thread or a bayonet cap fitting, in order to change the light bulb it is necessary to apply a twisting force to the glass envelope in order to both engage and disengage the light bulb from its fitting. In addition, the increasingly prevalent use of aluminum instead of brass in the base of the bulb has tended to increase problems caused by the bending or other malfunction of the base. A common fault is that the bond between the glass envelope and the base is broken. Grudgefield identifies that a twisting force is necessary to screw or unscrew the bulb, and he identifies the problem of breaking bulbs or separating them from their Edison screw base but he does not identify a solution of controlling the torque applied to the bulb to prevent such an occurrence. This invention does not provide the ability to adjust the fingers from both the proximal and distal ends.

U.S. Pat. No. 4,719,826 to DuBois discloses a light bulb extractor with a steel U-shaped pair of gripping arms formed from steel having the proper size and shape to fit over the end of a lamp bulb. The tips of the gripper arms are formed to fit the end of the bulb and the steel is then annealed to obtain the required spring characteristics. The tips of the gripping arms are covered with plastic to provide friction between the gripping arms and the bulb. A chain is attached between the arms with a second chain attached to its center. Pulling the second chain will close the gripping arms. A slot is provided to secure the second chain to hold the arms at any desired span. Extensions can be attached to the gripper arms when the device is used on high overhead lamps. The steel used in the gripper arms is thin to fit between the bulb and fixture when the bulb is mounted in deep fixtures. DuBois also identifies the need for friction between the fingers and the bulb but does not identify a solution to control the torque of the fingers. The patent does disclose the use of a chain to be pulled by the operator to grip the bulb such that the operator must pull the chain and turn the device to screw or unscrew the bulb simultaneously which is a difficult operation for some individuals. This invention also does not control the amount of torque which can be applied to a light bulb regardless of the size of the bulb.

U.S. Pat. No. 5,317,939, Marinescu, teaches a light bulb changing device including an extended pipe, an annular head is connected to an upper end of the pipe. A finger clamp assembly is carried within the annular head. A handle is slidable within a lower end of the pipe and is depressible by another hand of the person. A structure is coupled to the handle within the pipe for operating the finger clamp assembly. The finger clamp assembly can grip a light bulb to install and remove the light bulb from a lighting fixture at an elevated position from a floor. The invention utilizes a compression spring to apply a force to the spring fingers to grip a light bulb however Marinescu does not identify a solution to controlling the torque applied to the light bulb. Further, while the invention provides that the device may have an extended pole to access elevated light bulbs, the invention does not provide a means to open the fingers at the distal or finger end of the device so as to allow insertion of a new light bulb. This invention does not provide the ability to adjust the fingers from both the proximal and distal ends.

U.S. Pat. No. 6,883,400 Sugano, describes a device for changing a light bulb comprising an outer tube and an inner tube positioned inside the outer tube, wherein the tubes are adjustable along a longitudinal axis. The inner tube having a rotating member which is rotatable about the longitudinal axis by a grip attached to the inner tube. The device comprising a flexible arm with a flex cable running through the arm, wherein the arm is connected to the outer tube. The flex cable in the flexible arm rotates in agreement with the rotating member by means of a transferring mechanism and drives a clasping mechanism comprising a plurality of spring urged fingers. The spring urged fingers are adjustable to clasp different sized light bulbs by a sliding collar coupled to the clasping mechanism. This device has several problems inherent to the invention. Ceiling light bulbs are typically a minimum of 8 feet above the floor requiring that the light bulb changer must be extended to a dimension allowing a normal person to reach the light bulb with the changing device. To remove a light bulb from an extended location the user must adjust the sliding collar and spring fingers when the head unit is located at a person-reachable location. This adjustment must be made to allow the fingers to impart adequate torque to remove the light bulb. The user can only guess what the proper adjustment of the sliding collar must be. If the adjustment is made incorrectly then the sliding collar must be readjusted, possibly multiple times. This presents a cumbersome process for removing a light bulb. Further, the disclosed device is unduly complicated creating a very expensive execution. This invention also does not control the amount of torque which can be applied to a light bulb regardless of the size of the bulb. This invention does not provide the ability to adjust the fingers from both the proximal and distal ends.

SUMMARY OF THE INVENTION

A primary object of the present invention is to provide a light bulb changing tool that will overcome the shortcomings of the prior art devices.

Another object is to provide a light bulb changing tool that will grip a light bulb at an upper end, so that the light bulb can be installed or removed from a ceiling outlet located at an elevated position above a floor.

An additional object is to provide a light bulb changing tool that is adaptable to grip and stabilize various sized and shaped light bulbs, so that each light bulb can be properly installed and removed from the ceiling outlet.

Another object of the invention is to provide a light bulb changing device that can be actuated by the user from either the distal or proximal end and that the actuation force is reduced so that older or weaker individuals can easily operate the device. Operation from the distal end allows a user to insert or remove a bulb while working at the distal end. Operation from the proximal end allows the user to grab or release a bulb when the distal end is at an elevated position not reachable by the user.

An additional object of the invention is to provide a light bulb changing device that can be adjusted in length to accommodate use for various ceiling heights.

A further object is to provide a light bulb changing tool that is simple and easy to use.

A still further object is to provide a light bulb changing tool that is economical in cost to manufacture.

A further object of the invention is to provide a light bulb changing device that controls the amount of torque applied to the light bulb so as to avoid causing the glass bulb being broken away from the metal Edison thread, and yet to have enough torque to remove a difficult bulb.

BRIEF DESCRIPTION OF THE DRAWINGS

Further objects of the invention will appear as the description proceeds.

DETAILED DESCRIPTION OF THE PREFERRED EMBODIMENTS

Figure 1:
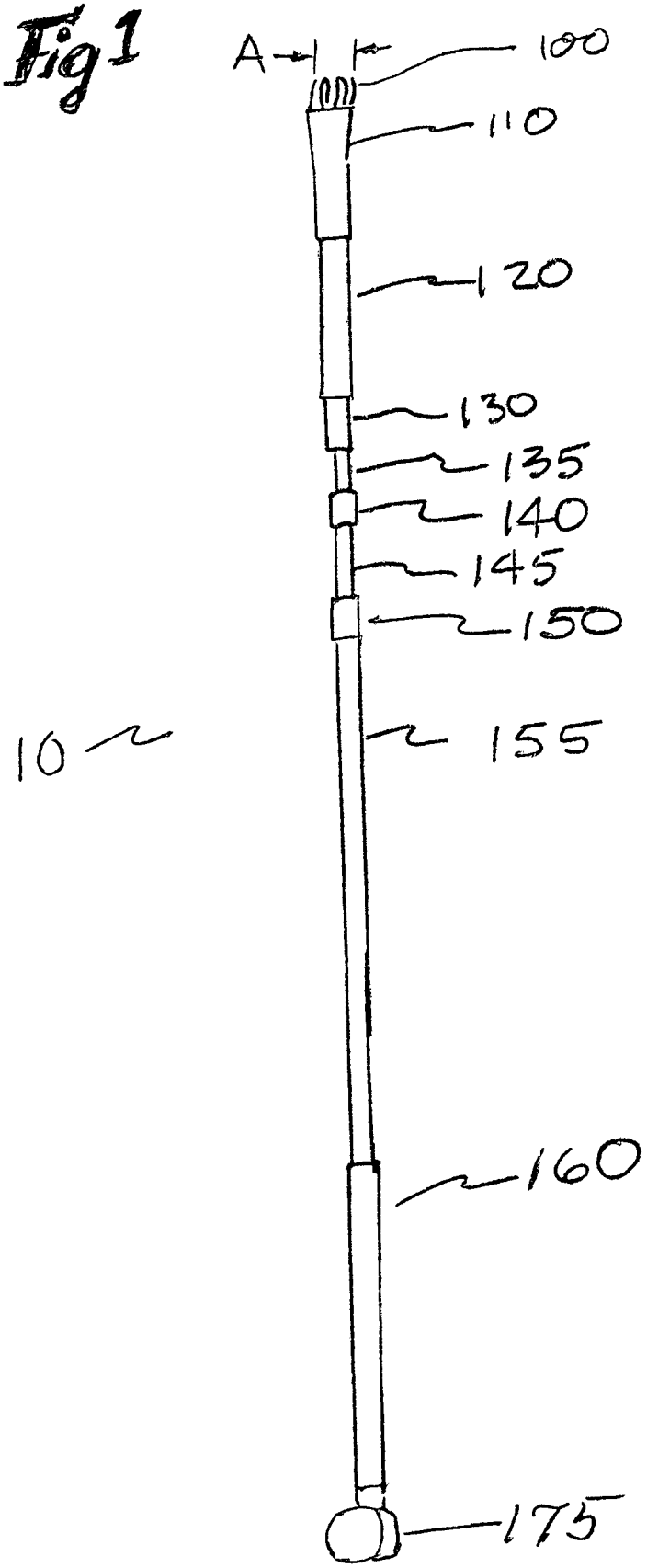
FIG. 1 is a view of the full length of the disclosed light bulb changer, (to be abbreviated subsequently as lbc) showing the distal end with flexible fingers shown in the retracted position and proximal end shown with the retraction reel and handle.
Figure 2:
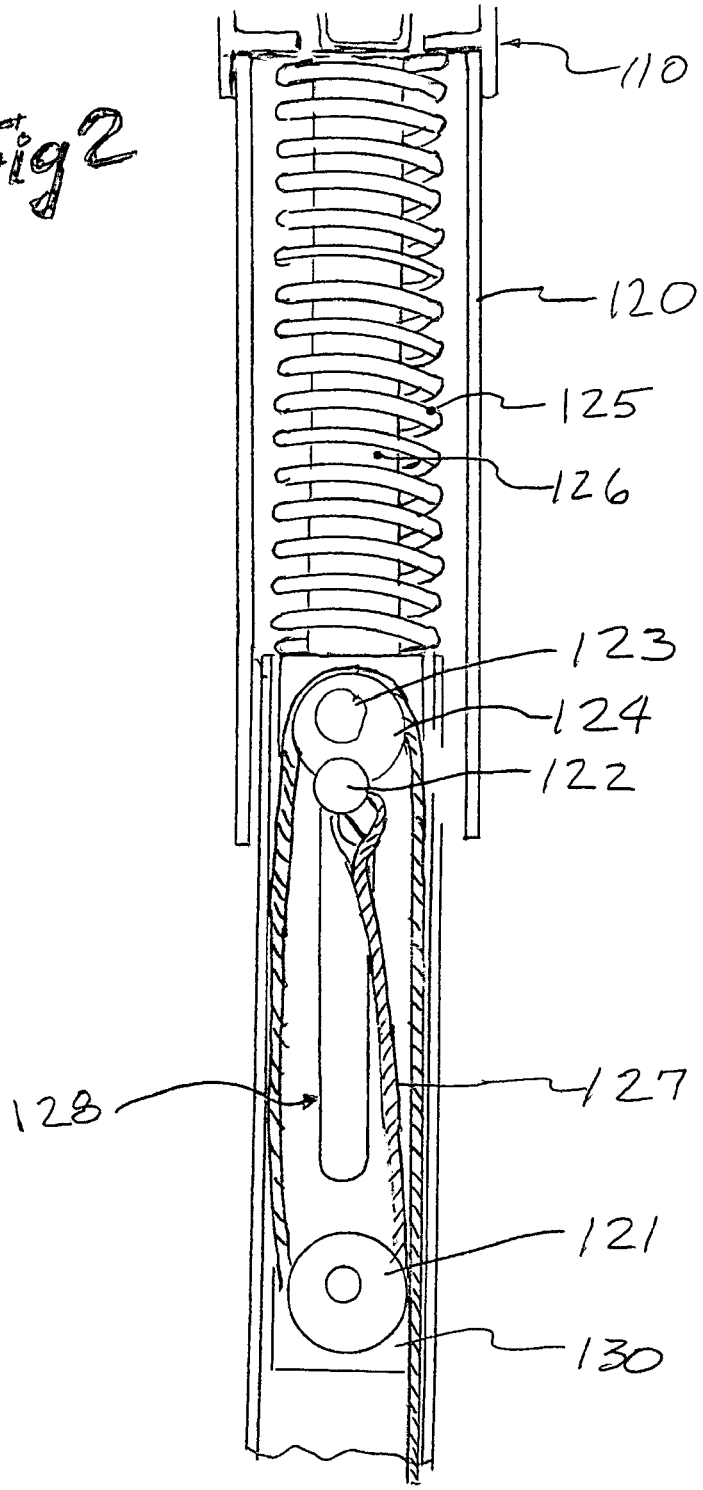
FIG. 2 is a view of the distal end shown with the flexible fingers shown in the opened position

FIG. 1 shows a light bulb changer 10. At a distal end of the disclosed light bulb changer 10, from here on to be abbreviated to lbc, flexible fingers 100, said fingers having a preferred curvilinear shape, said fingers shown in the fully retracted position, dimension A. The light bulb changer 10 includes a horn 110 which helps to control the position of the at least two flexible fingers and a tube 120 which encases a compression spring which is shown in FIG. 2. Also shown, the light bulb changer includes a pulley housing 130, a small diameter extension tube 135, and a small bushing 140 which provides a low friction sliding surface between said metal tubes such that metal does not slide against metal.

The light bulb changer 10 further includes an intermediate diameter extension tube 145, a large bushing 150 used to prevent metal-to-metal sliding, large diameter extension tube 155, said more than one extension tubes and said bushings combine to provide a set of at least two telescoping extension tubes to allow the user to expand or contract along an axial direction to provide for a greater or lesser axial length for the purpose of allowing the user to extend his reach to lower or higher positioned light bulbs.

At a proximal end of said lbc 10, a sliding handle 160 is fixedly connected to a take up reel 175. The sliding handle is slid in an axial direction opposite from the flexible fingers for the purpose of expanding the flexible fingers to a larger dimension suitable to grasp a variety of light bulb sizes. The bulbs having diameters between approximately 1.5 inches to approximately 5.5 inches. The slide handle can then be released, allowing said flexible fingers to grasp the light bulb at the preferred torque to assure bulb removal but limiting said torque to between approximately 5 and 25 inch pounds that will not cause the glass bulb to separate from the metal base of the bulb.

FIG. 2 illustrates a cross-section of the horn 110, shown expanded in an axially distal direction allowing said flexible fingers to be forced to a closed smallest dimension. Flexible fingers illustrated in FIG. 1 have a natural shape and a compressed shape. The compressed shape is of a dimension A to grasp the smallest of light bulbs. The natural shape of said flexible fingers is such that it is much larger than dimension A. Said horn 110 is fixed to the tube 120.

A compression spring 125 is shown in an axially largest condition. A connecting rod, 126 is shown, said connecting rod is fixedly connected to said flexible fingers on a central axis, said connecting rod 126 also is fixedly connected to the pulley housing 130. The pulley housing 130 encasing a moving pulley 124 rotatable around a center point 123, a fixed pulley 121, and a pin 122. The pin 122 and moving pulley 124 are moveable in a slot 128, provided in said pulley housing 130 and the moving pulley 124 and the pin 122 are fixed to the tube 120.

A cable 127, or any flexible tension member known in the art, having a first end and a second end is routed around said moving pulley 124, said fixed pulley 121 and a second end is terminated at said pin. The tension member 127, the fixed pulley 121 and the moving pulley 124 act together as a system to improve the mechanical advantage for an operator to more easily actuate said light bulb changer from the proximal end.

Said cables first end is guided preferably through the annulus of tubes 135, 145, and 155 (of FIG. 1) and guided to terminate said first end at the reel 175 of FIG. 1. The function of adjusting said flexible fingers to a preferred dimension, dimension A or larger than dimension A, to allow the user to grasp a light bulb of a certain size is accomplished in a first method and a second method.

The first method is utilized when an operator is removing a light bulb from a ceiling fixture. The operator first extends the telescoping pole to a preferred length to permit access to the bulb. He then grips the large extension tube (155 of FIG. 1) with a first hand and grips the sliding handle (160 of FIG. 1) with a second hand.

He then pulls the sliding handle axially in a proximal direction which expands the flexible fingers (100 of FIG. 1) to a preferred dimension to allow said fingers to grip the bulb. He then releases the sliding handle which allows the compression spring (125 of FIG. 2) to force the horn (120 of FIG. 2) in a distal direction to in turn apply force on the flexible fingers to grip the bulb. He then rotates the light bulb changer 10 and light bulb counterclockwise to unscrew the bulb.

The second method is then used to extract the bulb from the grip of the flexible fingers and insert a new replacement bulb. The operator does this by placing the reel (175 of FIG. 1) end against the floor of the room and with a first hand grips the tube (120 of FIG. 1) and with a second hand he grips the bulb. He then slides the tube in a direction toward the proximal, reel end of the light bulb changer thereby releasing the grip of the flexible fingers on the bulb.

For installing a new bulb, the user reverses the process including placing a new bulb in the fingers, inserting by rotating clockwise, and disengaging the fingers once the bulb is installed.

Figure 3:
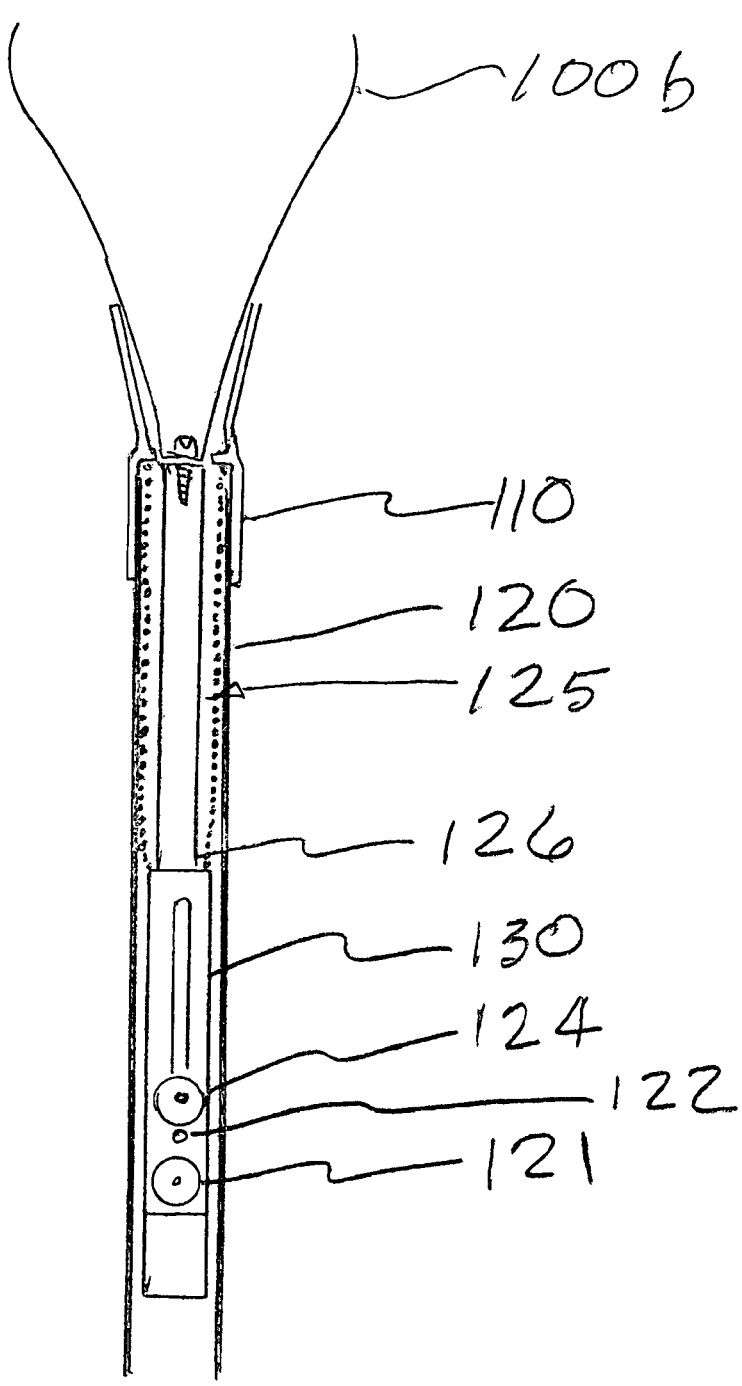
FIG. 3 is a view of the distal end shown with the flexible fingers in the retracted position.

FIG. 3 illustrates the light bulb changer with said horn 110 moved axially toward the proximal end of the light bulb changer. Said horn 110 is shown in its fully proximal position which compresses said compression spring 125 to its fully compressed condition. The compression spring 125 is within the tube 120, the connecting rod 126 running therein.

The fingers 100*b* showing in an open or outwardly-extended position. Said horn 110 when in said position allows the at least two flexible fingers 100*b* to expand to their fully expanded position of preferably between 4 to 6 inches. Also visible in FIG. 3, the pulley housing 130 shows the moving pulley 124 and pin 122 moved downward towards the proximate end of the light bulb changer, closer to the fixed pulley 121, when viewed in comparison to FIG. 2.

Figure 4:
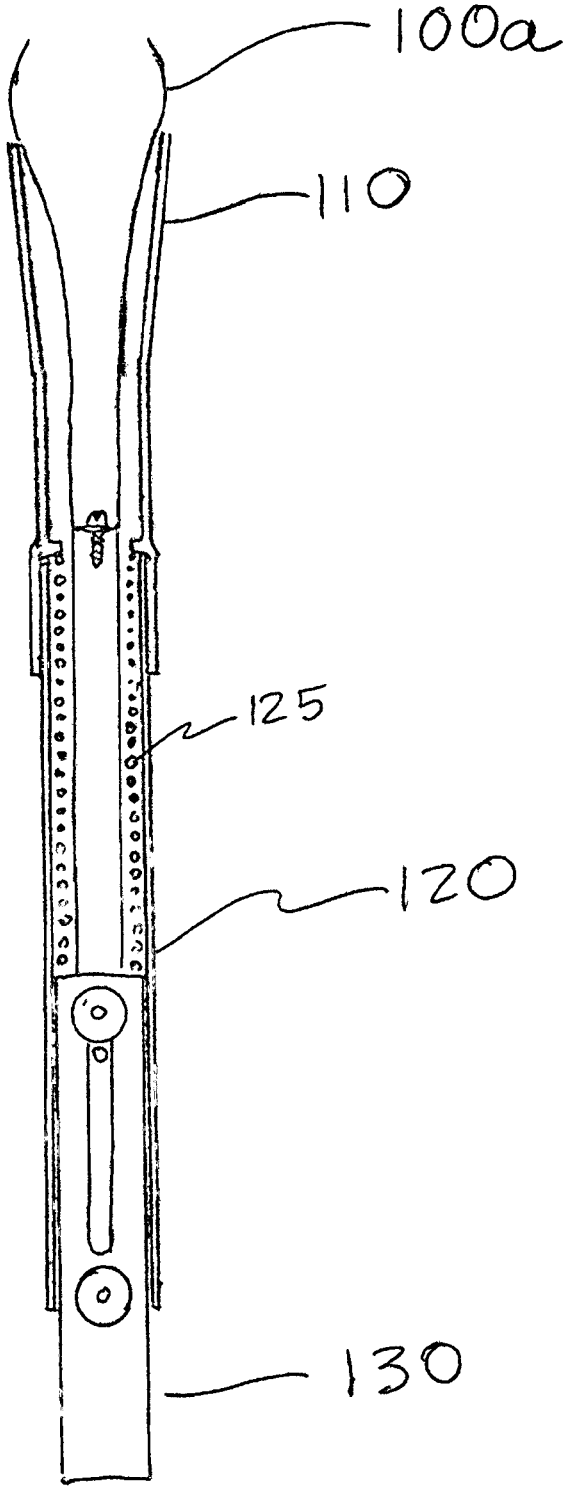
FIG. 4 is a view of a portion of the internal mechanism located at mostly the distal end showing the compression spring and retraction cable and pulleys.

FIG. 4 illustrates the light bulb changer with said horn 110 moved axially toward the distal end of the light bulb changer, away from the pulley housing 130. Said horn 110 is shown in its fully distal position which compresses said compression spring 125 within the tube 120 to its least compressed condition. Said horn 110 when in said position forces the at least two flexible fingers 100*a* to close to their fully closed position of preferably between 1 to 3 inches.

Figure 5:
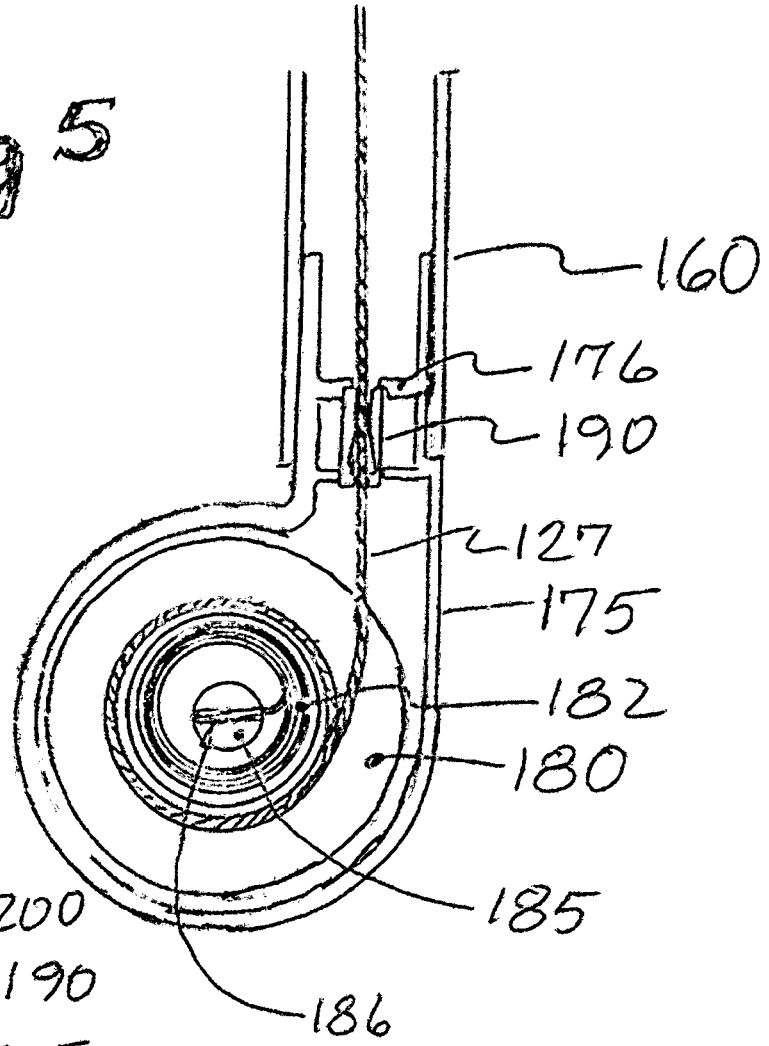
FIG. 5 is a view of the proximal end showing the cable retraction and gripping mechanism.

FIG. 5 illustrates the proximal end of said lbc. Slide handle 160 is fixedly connected to the take up reel 175 which encases drum 180. The drum 180 encases a torsion spring 182 on a common axis, said torsion spring is commonly known as a clock spring. The torsion spring 182, having a first and second end, the first end is attached to the inside diameter of said drum 180 said second is attached to a slot 186 in a spring axle 185, which may be molded as part of take up reel.

Figure 5A:
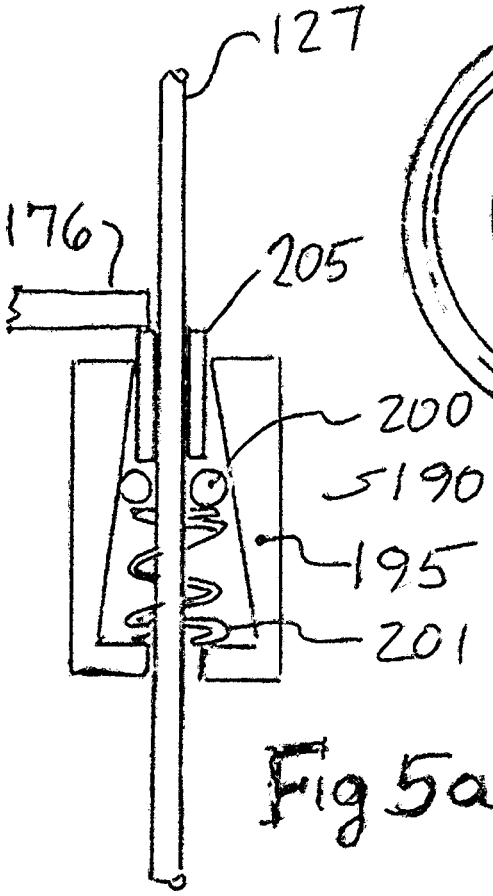
FIG. 5*a* is a cross sectional view of the cable gripper which is utilized to releasably grip the cable in a first direction while allowing release in a second direction.

Said reel 175 also encases a cable gripper 190 with at least one upper wall 176 shown in greater detail in FIG. 5*a*. Tension member 127, also referred to as a cable, being preferably fed through said annulus of said small medium and large diameter tubes from said distal end of the lbc is then guided through said cable gripper 190, then guided around said drum 180 at least one full circumference and said first end of said cable 127 is fixedly terminated on said drum 180.

When the lbc is in a first condition of the extension tubes at their most fully extended axial length, said drum 180 will have a preferred at least one full circumference of said cable 127 wrapped around said drum 180. In this condition said torsion spring 182 will be at its most fully wrapped condition.

When the lbc is in a second condition of the extension tubes being at their smallest axial dimension, the length adjustment member, including said torsion spring 182, forces said drum to rotate thereby wrapping said cable 127 around said drum 180, and said torsion spring 182 is at its least wrapped condition.

When the operator locks said pole at a preferred pole extended dimension, said cable gripper 190 is in its gripping position so that when the operator actuates said sliding handle 160 said cable gripper 190 will grip said cable 127 so that said cable 127 will actuate said pulleys and horn and flexible fingers at said distal end of said lbc.

FIG. 5*a* illustrates detail function of said cable gripper 190. The cable gripper 190 includes a tapered housing 195, which has a conically shaped internal lumen. At least 2 spherical balls 200 ride on said internal conical lumen and are forced to a smallest end of said conical lumen by a compression spring 201. An annular shaped sleeve 205, with a length and inner diameter and an outer diameter is placed around said cable 127.

The purpose of said cable gripper is to prevent the cable 127 from unwrapping from said drum (180 of FIG. 5) when said first method of adjusting said flexible fingers to a preferred dimension is being used. As said slide handle is moved in an axial direction toward the proximal end of said lbc said balls 200 are forced toward the smaller end of said conical lumen thereby gripping said cable 127 and preventing said cable 127 from unwrapping from said drum.

When an operator wishes to utilize said second method of adjusting the dimension of said flexible fingers, said cable gripper 190 is in the condition where said balls 200 are gripping said cable 127. The operator grips said tube with a first hand and axially slides said tube and horn in a proximal direction which moves moving pulley and pin (124 and 122 of FIG. 3) to a reduced axial dimension to said fixed pulley (121 of FIG. 3) thereby making said cable 127 to have slack since said pulleys have been moved closer together (as visible in FIG. 3). The slack cable 127 is then wrapped around said drum due to the torque imparted to said drum from said torsion spring.

When the operator wishes to extend said extension tubes to a longer axial dimension, said slide handle and reel and cable gripper 190 are pulled in a minimally axially distal direction by the force of the operator extending said extension tubes until said cable gripper 190 is stopped from said axial movement by wall 176 which pushes said sleeve 205 which in turn push balls 200 thereby releasing the balls' 200 grip on said cable 127. Wall 176 may be molded as an integral part of said reel.

Figure 6:
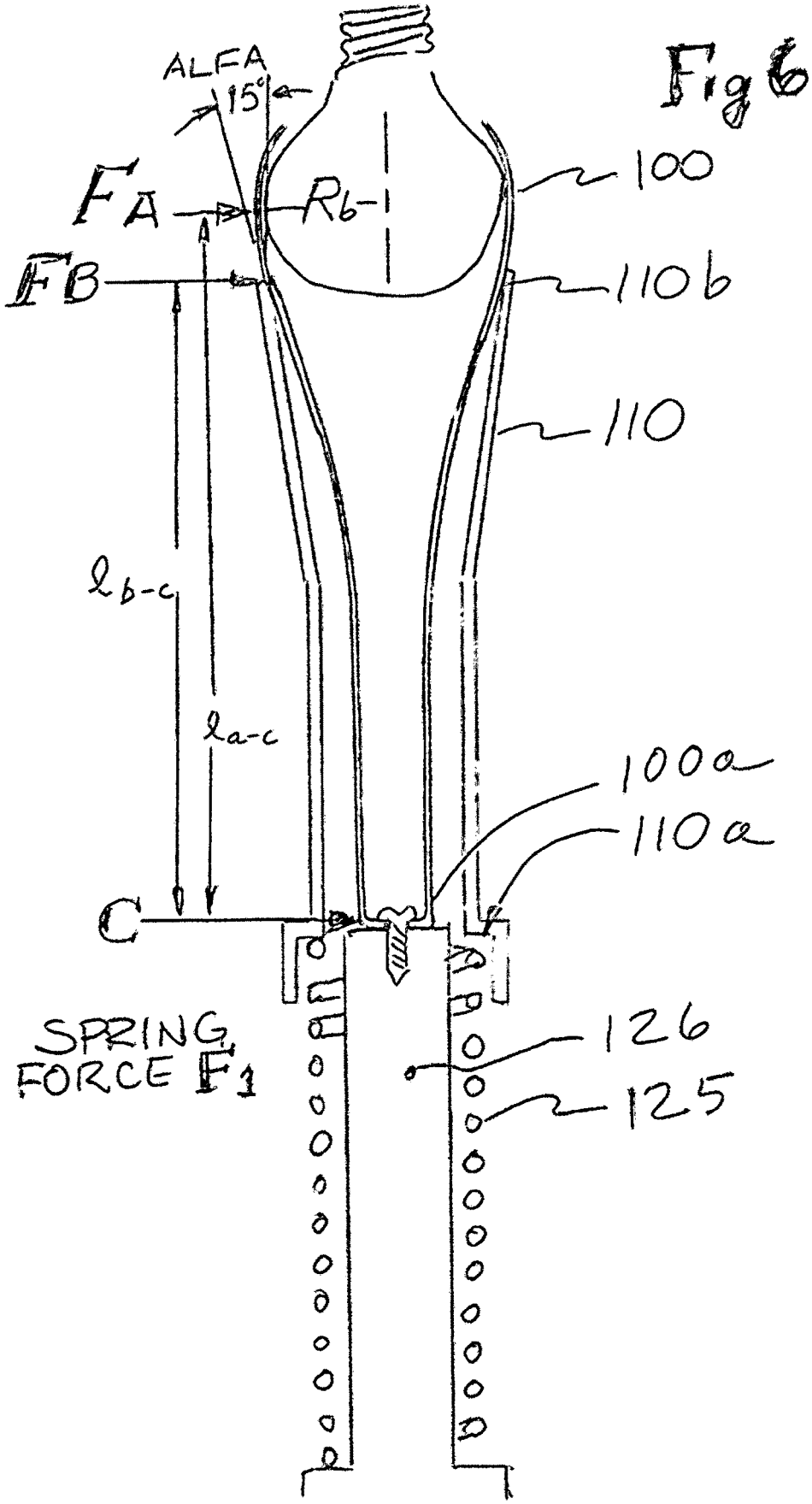
FIG. 6 is a schematic view of the distal end with the flexible fingers in the retracted position and showing locations and directions of the forces which are applied to the flexible fingers by the compression spring.

FIG. 6 illustrates said flexible fingers 100. The fingers 100 include a bottom portion 100*a* where engaged with the connecting rod 126. The fingers 100 are in a condition of being forced to their smallest dimension "A" by said horn 110 by contacting said flexible fingers 100 at point 110*b*. The horn 110 is in contacting engagement with the force of the compression spring 125 at connection point 110*a*.

Compression spring 125, affixed around the connecting rod 126, produces a force F1 in an axially distal direction on said horn 110 through an angle alfa which is the angle of said spring finger to said axis of lbc. Force F1 acting through said angle alfa produces a force Fb on said flexible fingers 100 in a direction perpendicular to the axis of said lbc.

Said flexible fingers 100 then produce a force Fa on the perimeter of the light bulb. Force Fa is a normal force on the perimeter of the light bulb which causes a force of friction acting through the coefficient of friction between the light bulb and said spring finger. A stated object of this invention is to control the torque applied to said light bulb so as to not cause failure of the glass light bulb to metal base connection. Torque is a function of the following dimensions and angles illustrated in Table 1. Force F1, Force Fa, Force Fb, radius of bulb Rb, distance La-bc, distance Lab-c and coefficient of friction $\mu$ between flexible fingers and light bulb dimension "B" by said Horn 110 by contacting said flexible fingers at point 110*b*.

Figure 7:
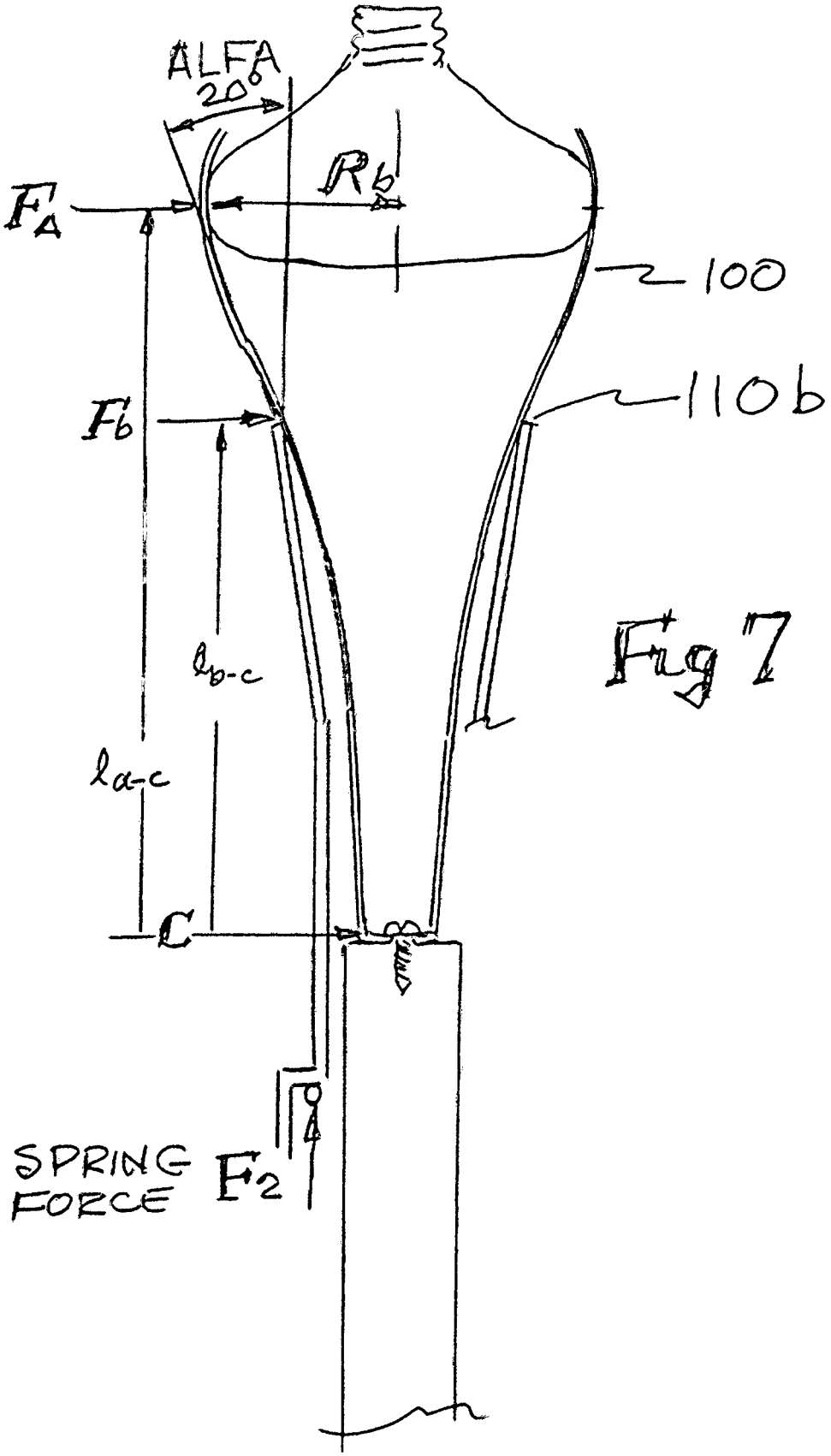
FIG. 7 is a schematic view of the distal end with the flexible fingers in a first intermediate opened position and showing locations and directions of the forces which are applied to the flexible fingers by the compression spring.

FIG. 7 illustrates said flexible fingers in a condition being forced to an intermediate position. In this intermediate position of said horn 110*b* engaging the fingers 100, said compression spring (not visible) is in a state of greater compression as compared to the position illustrated in FIG. 6 thus force F2 is higher than said force F1. Said Force F2, Force Fa, Force Fb, radius of bulb Rb, distance La-bc, distance Lab-c are all different than illustrated in FIG. 6 as they change continuously as said horn to said flexible fingers position changes.

TABLE 1

The object is to calculate the torque applied to tighten of loosen the bulb
Referring to FIG. 6
the spring force increases as it is compressed
the force that the horn applies to the fingers changes due the angle alfa and the ratio of Lb-c/La-c
the torque applied to the bulb increases as the bulb diameter increases
Spring force is measured a the 4 different points
Fb is calculated by dividing it by the tangent of Alfa
Fa is calculculated by doing the sum of moments about C
Fb × Lb-c − Fa × La-c = 0
Fa = Fb(Lb-c/La-c)
Torque applied to bulb = Fa × coefficient of friction × radius of bulb

| | | ANGLE ALFA | | | | | RATIO | | | FRICTION | TORQUE |
|---|---|---|---|---|---|---|---|---|---|---|---|
| SPRING | FORCE | ALFA | RADIANS | Fb | La-c | Lb-c | Lbc/Lac | Fa | Rb | Coefficient | ON BULB |
| F1 | 11.0 | 15.0 | 0.3 | 42.2 | 5.0 | 4.5 | 0.9 | 38.0 | 0.9 | 0.3 | 10.0 |
| F2 | 14.6 | 20.0 | 0.3 | 41.3 | 5.0 | 3.6 | 0.7 | 29.7 | 1.4 | 0.3 | 12.3 |
| F3 | 17.7 | 20.0 | 0.3 | 50.0 | 5.0 | 3.0 | 0.6 | 30.0 | 1.8 | 0.3 | 15.8 |
| F4 | 21.0 | 17.0 | 0.3 | 70.6 | 5.0 | 2.1 | 0.4 | 29.7 | 2.3 | 0.3 | 20.6 |

Figure 8:
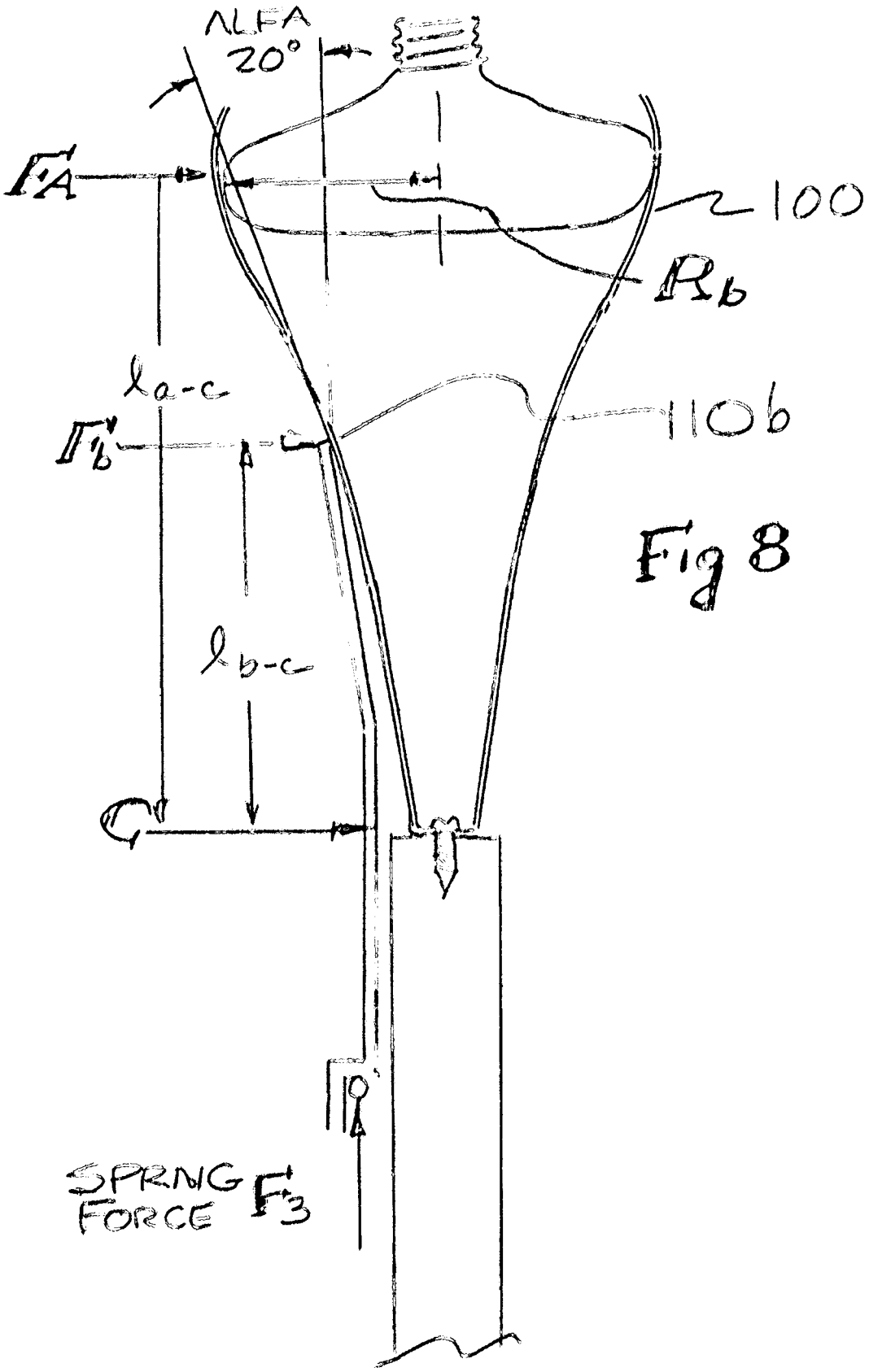
FIG. 8 is a schematic view of the distal end with the flexible fingers in a second intermediate opened position and showing locations and directions of the forces which are applied to the flexible fingers by the compression spring.

FIG. 8 illustrates said flexible fingers 100 in a condition being forced to an intermediate dimension "C" by said horn by contacting said flexible fingers at point 110*b*. In this second intermediate position of said horn, said compression spring is in a state of greater compression as compared to the position illustrated in FIG. 7 thus force F3 is higher than said force F2. Said Force F3, Force Fa, Force Fb, radius of bulb Rb, distance La-bc, distance Lab-c are all different than illustrated in FIG. 7 as they change continuously as said horn to said flexible fingers position changes.

Figure 9:
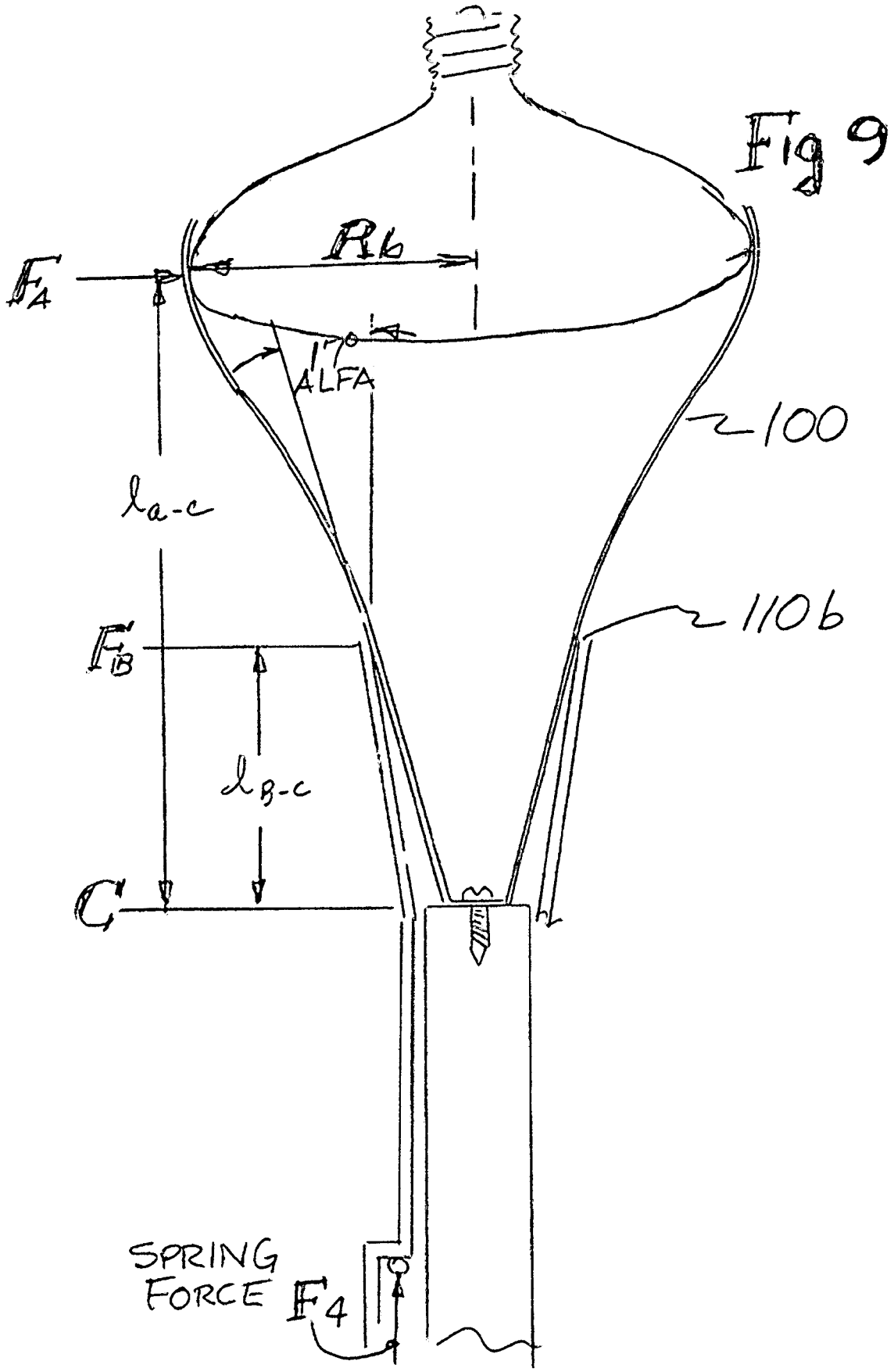
FIG. 9 is a schematic view of the distal end with the flexible fingers in a fully opened position and showing locations and directions of the forces which are applied to the flexible fingers by the compression spring, and table 1

FIG. 9 illustrates said flexible fingers in a condition being forced to an intermediate dimension "D" by said horn by contacting said flexible fingers 100 at point 110*b*. In this position of said horn, shown in its most axially retracted position, said compression spring is in a maximum state of compression as compared to the position illustrated in FIG. 8 thus force F4 is higher than said force F3. Said Force F4, Force Fa, Force Fb, radius of bulb Rb, distance La-cb, distance Lab-c are all different than illustrated in FIG. 7 as they change continuously as said horn to said flexible fingers position changes. Using the geometry and forces illustrated in FIG. 6 through FIG. 9 exemplary calculations are illustrated at said four positions of said horn to said flexible fingers resulting in predicted torques applied to light bulbs of dimensions A, B, C and D.

In another embodiment, light bulb changing device may not include telescoping of the extension tubes 135, 145 and 155. Rather, one embodiment can include a fixed length tube, such as tube 120 extending from the horn at the top portion and the sliding handle at the bottom portion. In these embodiment, the pulleys provide a mechanical advantage, whereby varying embodiments can exclude pulley and drum or torsion spring.

Maintaining reference numerals for FIG. 1, in this embodiment, the tube 120 is connected to the sliding handle 160 at the proximal end and at the distal end fixed to the horn 110. In this embodiment there are no telescoping tubes and as such no need for a take up reel 175. The cable 127 is fixedly connected to the sliding handle 160 shown in FIG. 1 and at the distal end the cable is fixedly connected to pin 122 shown in FIG. 2. In this embodiment the function of adjusting the fingers to a preferred dimension is the same as described above. In the first method of adjusting the fingers to a preferred dimension the cable is moved in a proximal direction in unison with the sliding handle. The distal end of the cable pulls the pin 122 which is fixedly connected to the pully housing 130 in an axially proximal direction which expands the flexible fingers to a preferred dimension to allow said fingers to grip the bulb.

In the second method, for releasing the bulb from the fingers, the operator places the reel end against the floor of the room and with a first hand grips the tube 120 and with a second hand he grips the bulb. He then slides the tube 120 in an axial direction toward the proximal end of the light bulb changer thereby releasing the grip of the flexible fingers on the bulb. In this method the cable is slack within the anulus of the tube 155 shown in FIG. 1.

Thus, the object of the invention to control the torque applied to the light bulb is demonstrated. The invention may have greater or lesser dimension, forces and angle alfa and are still within the scope of the invention.

What is claimed is:

1. A light bulb changing device comprising:

a tube having a top end and a bottom end;

a plurality of flexible fingers connected to the top end of the tube and extending upward therefrom, each of the plurality of flexible fingers having a curvilinear shape and a predetermined length;

a horn slidably disposed on the top end of the tube and covering at least a portion of the plurality of flexible fingers, whereby slidable movement of the horn relative to the tube adjusts the plurality of flexible fingers between an open position and a closed position;

a compression spring disposed within the tube, the compression spring upon being compressed to a first length biasing the horn in a first position;

a tension member, a distal portion of the tension member connected to the horn;

a sliding handle connected to the bottom portion of the tube with a proximal portion the tension member engaging the sliding handle; and wherein sliding the sliding handle in a proximal direction effectuates movement of the horn to open the flexible fingers and releasing the handle effectuates movement of the horn to close the flexible fingers with controlled torque generated by the compression spring and based on a relative position of the fingers to the horn.

2. The light bulb changing device of claim 1, wherein the tension member is internally connected to the horn and extends between the proximal portion and distal portion within an interior the tube.

3. A light bulb changing device comprising:

a tube having a top end and a bottom end;

a plurality of flexible fingers connected to the top end of the tube and extending upward therefrom, each of the plurality of flexible fingers having a curvilinear shape and a predetermined length;

a horn slidably disposed on the top end of the tube and covering at least a portion of the plurality of flexible fingers, whereby slidable movement of the horn relative to the tube adjusts the plurality of flexible fingers between an open position and a closed position;

a compression spring disposed within the tube, the compression spring upon being compressed to a first length biasing the horn in a first position;

a pulley housing having a pulley therein, the pulley housing disposed at the top end of the tube having a tension member engaging the pulley to reduce a force amount to slidably move the horn;

an extension tube in telescoping engagement with the tube for adjusting a vertical reach of the tube and flexible fingers;

a sliding handle connected to a proximal end of the extension tube with a length adjustment member engaging the tension member extending therethrough; and a reel connected to the sliding handle, the reel engaging a proximal portion of the tension member extending through the sliding handle;

wherein sliding the sliding handle in a proximal direction effectuates movement of the horn to open the flexible fingers and releasing the handle effectuates movement of the horn to close the flexible fingers with a controlled torque generated by the compression spring and based on a relative position of the fingers to the horn.

4. The light bulb changing device of claim 3, wherein the reel includes a drum having the tension member wrapped therearound.

5. The light bulb changing device of claim 4 further comprising:

the length adjustment member comprising:

a tapered housing having the tension member extend therethrough;

at least two spherical balls disposed within the tapered housing; and a compression spring engaging the at least two spherical balls forcing the spherical balls against a smaller end the tapered housing; and a sleeve disposed annularly around tension member, the sleeve extending at least partially within an opening of the tapered housing;

wherein during movement of the sliding handle in the proximal direction, the length adjustment member inhibits the tension member from unwrapping from the drum within the reel.

6. The light bulb changing device of claim 5, wherein the reel further includes a torsion spring biased to keep the tension member wrapped around the drum.

7. The light bulb changing device of claim 3, wherein the pulley is a first pulley, the pulley housing having a second pulley disposed therein, working in conjunction with the first pulley and the tension member to reduce a force amount to slidably move the horn.

8. The light bulb changing device of claim 3, wherein the tension member is at least one of: a cable, a string, a rope, a ribbon, a wire, and a belt.

9. The light bulb changing device of claim 3, the plurality of flexible fingers includes at least four fingers equally circumferentially displaced extending upward from the top portion of the tube.

10. The light bulb changing device of claim 3, wherein the extension tube includes a plurality of intermediate extension tubes in telescoping engagement for adjusting a vertical reach of the tube and flexible fingers.

11. The light bulb changing device of claim 3 further comprising:

at least one locking member to secure the intermediate extension tubes at a selected length of the vertical reach.

12. The light bulb changing device of claim 11, wherein upon adjusting the vertical reach, the tension member rotates a drum within the reel to maintain a tension with the tension member connected to the pulley.

13. A light bulb changing device comprising:

a tube having a top end and a bottom end;

a plurality of flexible fingers connected to the top end of the tube and extending upward therefrom, each of the plurality of flexible fingers having a curvilinear shape and a predetermined length;

a horn slidably disposed on the top end of the tube and covering at least a portion of the plurality of flexible fingers, whereby slidable movement of the horn relative to the tube adjusts the plurality of flexible fingers between an open position and a closed position;

a compression spring disposed within the tube, the compression spring upon being compressed to a first length biasing the horn in a first position;

a pulley housing having a pulley therein, the pulley rotatably connected to the horn, the pulley housing disposed at the top end of the tube having a tension member engaging the pulley to reduce a force amount to slidably move the horn, a distal portion of the tension member connected to the pulley housing;

an extension tube in telescoping engagement with the tube for adjusting a vertical reach of the tube and the flexible fingers;

a sliding handle connected to the extension tube with a length adjustment member engaging the tension member extending therethrough; and a reel connected to the sliding handle and having a drum therein, the reel engaging a proximal portion of the tension member extending through the sliding handle having the tension member wrapped around the drum, wherein the reel further includes a torsion spring modulating connection of the tension member wrapped around the drum;

wherein sliding the handle in a proximal direction effectuates movement of the horn to open the flexible fingers and releasing the handle effectuates movement of the horn to close the flexible fingers with a controlled torque generated by the compression spring and based on a relative position of the fingers to the horn.

14. The light bulb changing device of claim 13 further comprising:

the length adjustment member comprising:

a tapered housing having the tension member extend therethrough;

at least two spherical balls disposed within the tapered housing; and a compression spring engaging the at least two spherical balls forcing the spherical balls against a smaller end the tapered housing; and a sleeve disposed annularly around tension member, the sleeve extending at least partially within an opening of the tapered housing;

wherein during movement of the sliding handle in the proximal direction, the length adjustment member inhibits the tension member from unwrapping for a drum within the reel.

15. The light bulb changing device of claim 13, wherein the pulley is a first pulley and the pulley housing having a second pulley disposed therein, working in conjunction with the first pulley and the tension member to reduce a force amount to slidably move the horn.

16. The light bulb changing device of claim 13, wherein the tension member is at least one of: a cable, a string, a rope, a ribbon, a wire, and a belt.

17. The light bulb changing device of claim 13, the plurality of flexible fingers includes at least four fingers equally circumferentially displaced extending upward from the top portion of the tube.

18. The light bulb changing device of claim 13, wherein the extension tube includes a plurality of intermediate extension tubes in telescoping engagement for adjusting a vertical reach of the tube and flexible fingers.

19. The light bulb changing device of claim 18 further comprising:

at least one locking member to secure the intermediate extension tubes at a selected length of the vertical reach.

20. The light bulb changing device of claim 19, wherein upon adjusting the vertical reach, the tension member rotates the drum within the reel to maintain a tension with the tension member connected to the pulley.

* * * * *